US008944022B2

(12) United States Patent
Fleck

(10) Patent No.: US 8,944,022 B2
(45) Date of Patent: Feb. 3, 2015

(54) PUMP ASSEMBLY FOR INTERNAL COMBUSTION ENGINE

(75) Inventor: Michael B. Fleck, Oakland Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 345 days.

(21) Appl. No.: 13/449,048

(22) Filed: Apr. 17, 2012

(65) Prior Publication Data

US 2013/0092117 A1 Apr. 18, 2013

Related U.S. Application Data

(60) Provisional application No. 61/548,524, filed on Oct. 18, 2011.

(51) Int. Cl.
*F01M 1/02* (2006.01)
*F02B 41/00* (2006.01)

(52) U.S. Cl.
CPC ..... *F01M 1/02* (2013.01); *F01M 2001/0269* (2013.01)
USPC ..... 123/196 R; 123/198 C; 184/6.5

(58) Field of Classification Search
CPC ..... F01M 1/02; F01M 1/12; F01M 11/02; F04C 29/025; B60T 13/52; F02B 77/14
USPC ..... 123/196 R, 198 C; 184/6.5; 417/364
See application file for complete search history.

(56) References Cited

U.S. PATENT DOCUMENTS

| | | | | |
|---|---|---|---|---|
| 4,586,468 | A * | 5/1986 | Dzioba | 123/198 C |
| 4,827,881 | A | 5/1989 | Baker et al. | |
| 5,791,311 | A | 8/1998 | Ozeki | |
| 6,345,600 | B1 * | 2/2002 | Schneider | 123/198 C |
| 2004/0247471 | A1 | 12/2004 | Lee et al. | |
| 2007/0059187 | A1 * | 3/2007 | Lo Biundo et al. | 417/364 |

FOREIGN PATENT DOCUMENTS

| | | | |
|---|---|---|---|
| CN | 1174948 | A | 3/1998 |
| DE | 102006030917 | A1 * | 12/2007 |

OTHER PUBLICATIONS

Chinese Office Action for CN Application No. 201210396552.X, dated Jun. 26, 2014, pp. 1-8.
English Abstract of Japanese Publication No. 63-259121, published Oct. 26, 1988, Titled: "Vacuum Generating Device for Internal Combustion Engine for Automobile", 1 page.

* cited by examiner

*Primary Examiner* — Noah Kamen
(74) *Attorney, Agent, or Firm* — Cantor Colburn LLP

(57) ABSTRACT

In one exemplary embodiment of the invention, an assembly for an internal combustion engine includes a crankshaft, a drive mechanism coupled to the crankshaft and an oil pump actuated by the drive mechanism. The engine also includes a vacuum pump actuated by the drive mechanism, wherein the drive mechanism, oil pump and vacuum pump are disposed in an oil pan and a housing disposed between the oil pump and vacuum pump configured to enclose at least a portion the drive mechanism and restrict a flow of oil from the oil pan into the housing to reduce aeration of the oil during operation of the internal combustion engine.

17 Claims, 2 Drawing Sheets

PUMP ASSEMBLY FOR INTERNAL COMBUSTION ENGINE

CROSS-REFERENCE TO RELATED APPLICATIONS

This patent application claims priority to U.S. Patent Application Ser. No. 61/548,524 filed Oct. 18, 2011 which is hereby incorporated herein by reference in its entirety.

FIELD OF THE INVENTION

The subject invention relates to internal combustion engines, and, more particularly, pump assemblies for internal combustion engines.

BACKGROUND

Internal combustion engines typically include an oil pump and vacuum pump. The oil pump is adapted to pump pressurized oil to lubricate various portions of the engine and/or supply working fluid for actuators in the engine. The vacuum pump is adapted to provide a vacuum directed to assist in operation of various devices in a vehicle, such as brakes or actuators.

In some cases, the oil pump and vacuum pump are driven by a shared drive mechanism. Arrangement and alignment of the pumps and the drive mechanism can be complex and may present a challenge for packaging in today's compact vehicles with smaller engine compartments.

SUMMARY OF THE INVENTION

In one exemplary embodiment of the invention, an assembly for an internal combustion engine includes a crankshaft, a drive mechanism coupled to the crankshaft and an oil pump actuated by the drive mechanism. The engine also includes a vacuum pump actuated by the drive mechanism, wherein the drive mechanism, oil pump and vacuum pump are disposed in an oil pan and a housing disposed between the oil pump and vacuum pump configured to enclose at least a portion the drive mechanism and restrict a flow of oil from the oil pan into the housing to reduce aeration of the oil during operation of the internal combustion engine.

In another exemplary embodiment of the invention, a pump assembly for an internal combustion engine includes a gear mechanism, an oil pump actuated by the gear mechanism and a vacuum pump actuated by the gear mechanism, wherein the gear mechanism, oil pump and vacuum pump are disposed beneath the internal combustion engine. The assembly also includes a housing disposed between the oil pump and vacuum pump configured to enclose a portion the drive mechanism and restrict a flow of oil into the housing to reduce aeration of the oil during operation of the internal combustion engine.

The above features and advantages and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of embodiments, the detailed description referring to the drawings in which.

DESCRIPTION OF THE EMBODIMENTS

Figure 1:
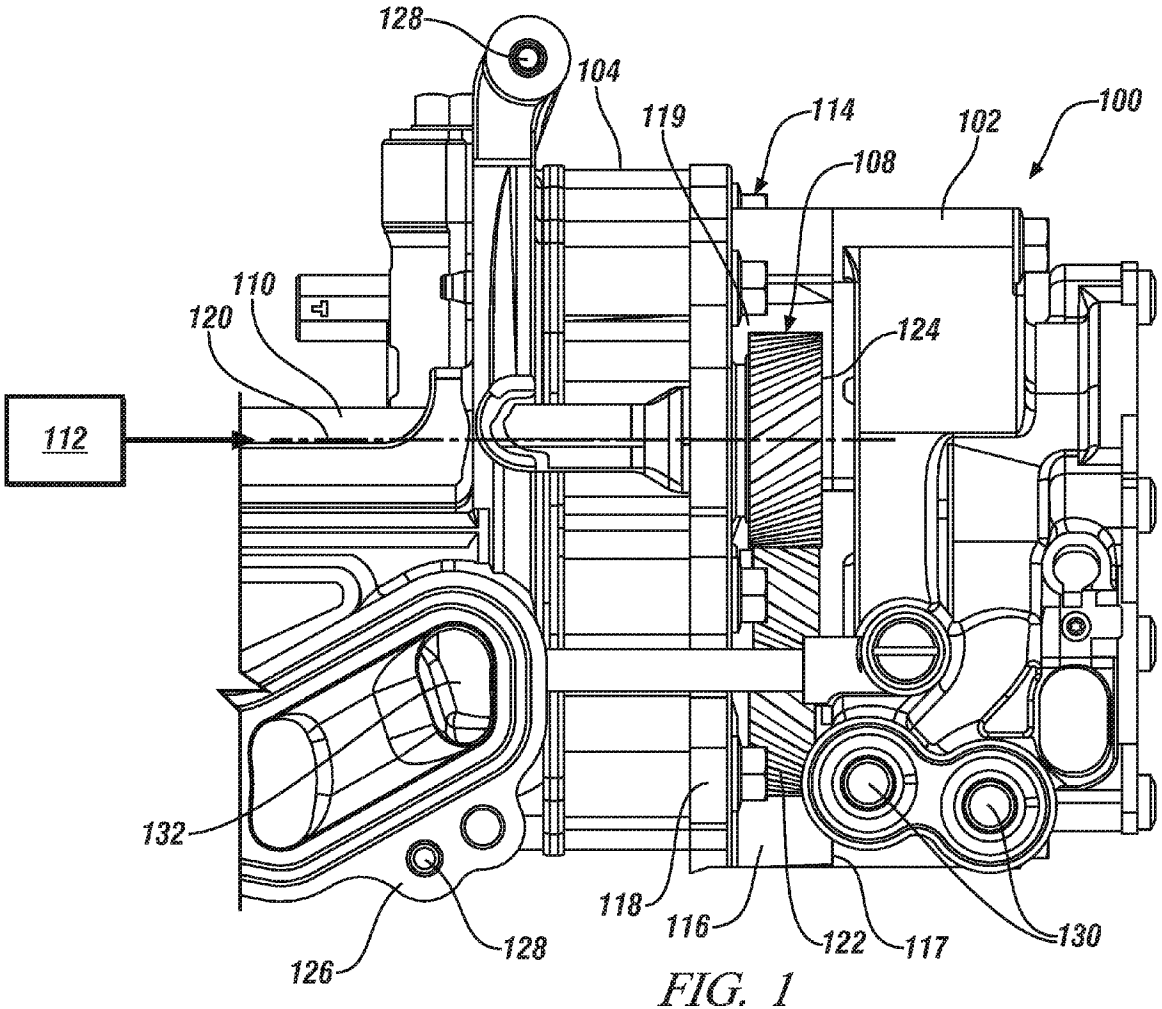
FIG. 1 is a partial top view of an exemplary pump assembly configured to be coupled to an internal combustion engine.

The following description is merely exemplary in nature and is not intended to limit the present disclosure, its application or uses. It should be understood that throughout the drawings, corresponding reference numerals indicate like or corresponding parts and features.

Figure 2:
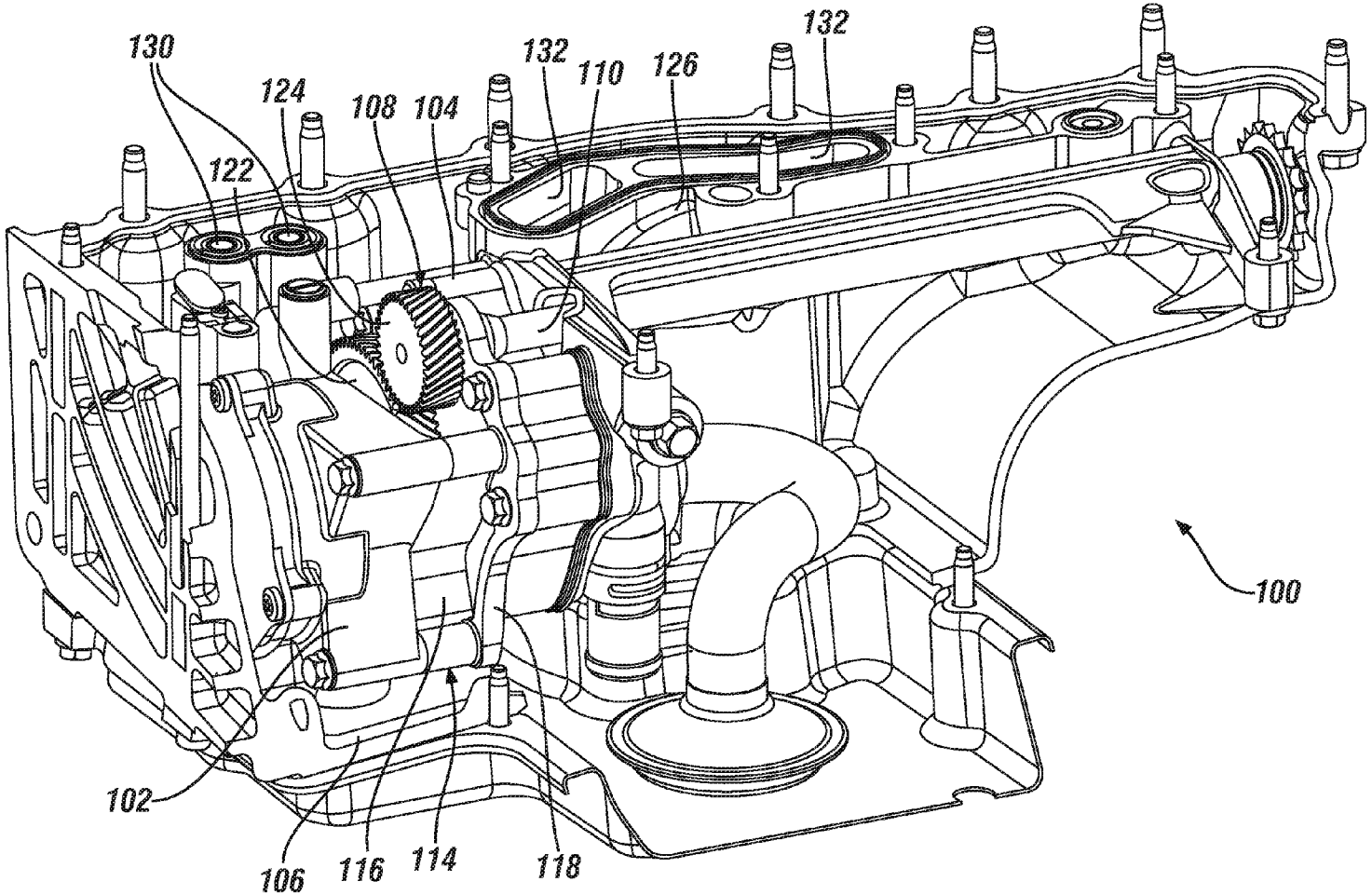
FIG. 2 is a perspective cutaway view of the pump assembly in FIG. 1.

In accordance with an exemplary embodiment of the invention, FIG. 1 is a top view of a pump assembly 100 to be used with an internal combustion engine (not shown), such as a spark-ignition or diesel engine. FIG. 2 is a perspective cutaway view of the exemplary pump assembly 100. The pump assembly 100 includes a vacuum pump 102 and oil pump 104 placed in an oil pan 106 (not shown in FIG. 1 to enhance clarity). In embodiments, the pump assembly 100 is disposed beneath an engine (not shown). A drive mechanism 108 is positioned between the vacuum pump 102 and oil pump 104, wherein the drive mechanism 108 provides motive force to actuate the pumps. The depicted drive mechanism 108 is rotatably driven by a drive shaft 110 disposed about an axis 120, where the drive shaft 110 is a part of or coupled to a crankshaft 112 of the engine. A housing 114 is disposed between the vacuum pump 102 and oil pump 104, where the housing 114 encloses a portion of the drive mechanism 108. As depicted, the housing 114 encloses a lower portion of the drive mechanism 108 while the upper portion of the drive mechanism 108 is not covered. In an embodiment, the housing 114 includes a radially outer wall 116 and a lateral wall 118. A side surface 117 of the radially outer wall 116 is coupled to the vacuum pump 102 while the lateral wall 118 is coupled to and adjoins the oil pump 104.

The housing 114 encloses the drive mechanism 108 to restrict flow of oil from the oil pan 106 into a cavity 119 formed by the vacuum pump 102 adjoining the housing 114. The cavity 119 receives a driven gear 122 and driving gear 124 of the driving mechanism 108. In an embodiment, the housing 114 provides a barrier to restrict oil flow and resulting oil aeration during movement of the drive mechanism 108. Specifically, in an embodiment without the housing 114, the oil level in the oil pan 106 is such that a portion of the gears 122, 124 are submersed in the oil. Thus, during rotation of the gears 122, 124, aeration and/or foaming occurs as the oil is churned by the gears. The housing 114 may be partially sealed or fully sealed to restrict fluid flow into cavity 119. In an embodiment, the housing 114 has one or more small passages or clearances that allow a small amount of fluid to leak into the cavity 119. When the gears 122, 124 rotate, they may cause oil that has leaked through the small passages into the cavity 119 to be directed outside the housing 114 and into the main reserve of oil in the oil pan 106. In an exemplary operation, the housing 114 shields the moving gears 122, 124 from churning through oil in the oil pan 106 reducing or discouraging aeration of the oil. In embodiments, the upper portions of the "U-shaped" radially outer wall 116 are configured to extend above the oil level in the oil pan 106. In other embodiments, the housing 114 fully encloses the drive mechanism 108 and, thereby, further restricts oil flow into the housing 114 and reduces oil aeration.

An oil distribution housing 126 is coupled to the oil pump 104 to receive and distribute oil to the engine (not shown). The oil distribution housing 126 couples to an engine block (not shown) via bolts 128 and is configured to direct pressurized oil through channels 132 to provide lubrication to various locations in the engine. In addition, the vacuum pump 102 includes vacuum line couplings 130 to connect to lines that provide vacuum pressure to selected locations in the vehicle. In an embodiment, the positions of the vacuum pump 102 and oil pump 104 may be reversed relative to the drive mechanism 108 and housing 114. The parts of the pump assembly 100 may be made from any suitable durable material, such as aluminum and/or steel alloys. For example, the housing 114 may be a single piece cast from an aluminum alloy. The housing 114 may also be machined to improve clearances and fit. In an embodiment, the housing 114 may be formed as separate pieces that are coupled together by a weld or other suitable technique. In an embodiment, the drive mechanism 108 may be any suitable mechanism capable of receiving rotational input and transmitting the input to the vacuum pump 102 and the oil pump 104. The drive mechanism 108 may use any suitable parts, including, but not limited to, gears, chains, sprockets, belts, pulleys or any combination thereof. The drive mechanism 108 is driven by any suitable driving force produced by an internal engine, such as rotational outputs of the crankshaft 112 or a camshaft. The drive mechanism may be coupled to the driving force, such as the crankshaft 112, directly or indirectly, via any suitable mechanism, such as shafts (e.g., drive shaft 110), gears, chains, sprockets, belts, pulleys or any combination thereof.

Embodiments of the pump assembly 100 and housing 114 restrict flow of oil from the oil pan 106 into the housing 114 to reduce oil aeration in the oil pan 106 during engine operation. Oil aeration can lead to various issues in the engine, including reduced oil compressibility for pumping, reduced oil density, oil pump cavitation and interruptions in oil flow to selected parts of the engine. Thus, by reducing incidence of oil aeration, the pump assembly 100 provides improved engine performance. Further, by positioning the drive mechanism 108 between the vacuum pump 102 and oil pump 104, the arrangement reduces parts and materials while providing a simplified design. In addition, by being placed between the vacuum pump 102 and the oil pump 104, the housing 114 uses a reduced amount of materials.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the application.

What is claimed is:

1. An assembly for an internal combustion engine, comprising:

a crankshaft;

a drive mechanism coupled to the crankshaft;

an oil pump actuated by the drive mechanism;

a vacuum pump actuated by the drive mechanism, wherein the drive mechanism, oil pump and vacuum pump are disposed in an oil pan; and a housing disposed between the oil pump and vacuum pump configured to enclose at least a portion the drive mechanism and restrict a flow of oil from the oil pan into the housing to reduce aeration of the oil by the drive mechanism during operation of the internal combustion engine, the housing including a radial outer wall coupled to the radial outer wall and one of the vacuum pump and the oil pump and a lateral wall coupled to the other of the vacuum pump and the oil pump.

2. The assembly of claim 1, wherein the drive mechanism comprises a driving gear and a driven gear, wherein the driven gear actuates the vacuum pump and the oil pump.

3. The assembly of claim 1, wherein the drive mechanism, oil pump and vacuum pump are disposed in the oil pan arranged at a lower portion of the internal combustion engine.

4. The assembly of claim 1, wherein the housing encloses a lower portion of the drive mechanism to restrict the flow of oil from the oil pan into the mechanism.

5. The assembly of claim 1, comprising an oil distribution housing coupled to the oil pump configured to direct a pressurized oil to selected locations in the internal combustion engine.

6. The assembly of claim 1, wherein the assembly is configured to be placed in a spark ignition gasoline engine.

7. The assembly of claim 1, wherein the radial outer wall coupled with the vacuum pump and the lateral wall coupled with the oil pump.

8. A pump assembly for an internal combustion engine, comprising:

a gear mechanism;

an oil pump actuated by the gear mechanism;

a vacuum pump actuated by the gear mechanism, wherein the gear mechanism, oil pump and vacuum pump are disposed beneath the internal combustion engine; and a housing disposed between the oil pump and vacuum pump configured to enclose a portion the drive mechanism and restrict a flow of oil into the housing to reduce aeration of the oil during operation of the internal combustion engine, the housing including a radial outer wall coupled to one of the vacuum pump and the oil pump and a lateral wall coupled to the radial outer wall and the other of the vacuum pump and the oil pump.

9. The assembly of claim 8, wherein the gear mechanism comprises a driving gear and a driven gear, wherein the driven gear actuates the vacuum pump and the oil pump.

10. The assembly of claim 8, wherein the gear mechanism, oil pump and vacuum pump are disposed in an oil pan arranged at a lower portion of the internal combustion engine.

11. The assembly of claim 8, wherein the housing encloses a lower portion of the drive mechanism to restrict the flow of oil from an oil pan into the mechanism.

12. The assembly of claim 8, comprising an oil distribution housing coupled to the oil pump configured to direct a pressurized oil to selected locations in the internal combustion engine.

13. The assembly of claim 8, wherein the assembly is configured to be placed in a spark ignition gasoline engine.

14. The assembly of claim 8, wherein the radial outer wall coupled with the vacuum pump and the lateral wall coupled with the oil pump.

15. An internal combustion engine, comprising:

a crankshaft;

a drive mechanism coupled to the crankshaft;

an oil pump actuated by the drive mechanism;

a vacuum pump actuated by the drive mechanism; and a housing disposed adjacent to the oil pump configured to enclose at least a portion the drive mechanism and restrict a flow of oil from the oil pan into the housing to reduce aeration of the oil during operation of the internal combustion engine, the housing including a radial outer wall and coupled to one of the vacuum pump the oil pump and a lateral wall coupled to the radial outer wall and the other of the vacuum pump and oil pump.

16. The engine of claim 15, wherein the housing and drive mechanism are disposed between the oil pump and vacuum pump.

17. The engine of claim 15, wherein the radial outer wall coupled with the vacuum pump and the lateral wall coupled with the oil pump.

* * * * *